US010876522B2

(12) United States Patent
Dhuri et al.

(10) Patent No.: US 10,876,522 B2
(45) Date of Patent: Dec. 29, 2020

(54) INSERT TYPE ROTOR FOR RADIAL PISTON DEVICE

(71) Applicant: EATON CORPORATION, Cleveland, OH (US)

(72) Inventors: Sanjeev Dhuri, Maharashtra (IN); Dhawal Goyal, Maharashtra (IN)

(73) Assignee: Eaton Intelligent Power Limited, Dublin (IE)

( * ) Notice: Subject to any disclaimer, the term of this patent is extended or adjusted under 35 U.S.C. 154(b) by 101 days.

(21) Appl. No.: 15/576,078

(22) PCT Filed: May 19, 2016

(86) PCT No.: PCT/US2016/033292

§ 371 (c)(1),
(2) Date: Nov. 21, 2017

(87) PCT Pub. No.: WO2016/187433

PCT Pub. Date: Nov. 24, 2016

(65) Prior Publication Data

US 2018/0142677 A1 May 24, 2018

Related U.S. Application Data

(60) Provisional application No. 62/164,880, filed on May 21, 2015.

(51) Int. Cl.
*F04B 1/1071* (2020.01)
*F04B 53/16* (2006.01)
*F04B 1/1077* (2020.01)

(52) U.S. Cl.
CPC ..... *F04B 1/1071* (2013.01); *F04B 1/1077* (2013.01); *F04B 53/16* (2013.01)

(58) Field of Classification Search
CPC ..... F04B 1/107; F04B 1/1071–1078
(Continued)

(56) References Cited

U.S. PATENT DOCUMENTS 1,726,481 A 8/1929 Ferris
3,744,378 A * 7/1973 Douglas ..... F04B 1/0456 91/484

(Continued)

FOREIGN PATENT DOCUMENTS

DE 10 2008 017 535 8/2009
EP 3 048 301 A1 7/2016

(Continued)

OTHER PUBLICATIONS

International Search Report and Written Opinion of the International Searching Authority for corresponding International Patent Application No. PCT/US2016/033292 dated Aug. 9, 2016, 16 pages.

*Primary Examiner* — Thomas E Lazo
*Assistant Examiner* — Daniel S Collins
(74) *Attorney, Agent, or Firm* — Merchant & Gould P.C.

(57) ABSTRACT

A radial piston device includes a housing (102), a pintle (110) attached to the housing (102) and having a pintle shaft (112), a rotor (130) rotatably mounted on the pintle shaft (112) and having cylinders (132), pistons (150) displaceably received in the cylinders (132), and a drive shaft (190) coupled to the rotor (130) and rotatably supported within the housing (102). The rotor (130) is made with two parts, such as a rotor body (250) and a rotor insert (252) received into the rotor body (250).

22 Claims, 6 Drawing Sheets

(58) Field of Classification Search
USPC ..... 92/72; 91/491–498
See application file for complete search history.

(56) References Cited

U.S. PATENT DOCUMENTS

| | | | | |
|---|---|---|---|---|
| 4,768,422 | A * | 9/1988 | Swinney ..... | F01B 13/068 417/221 |
| 7,484,939 | B2 | 2/2009 | Hansen | |
| 9,133,830 | B2 | 9/2015 | Hansen et al. | |
| 9,188,111 | B2 | 11/2015 | Hansen et al. | |
| 2015/0114216 | A1* | 4/2015 | Skinner, Jr. ..... | F04B 1/107 92/72 |
| 2016/0208610 | A1 | 7/2016 | Skinner et al. | |
| 2016/0252089 | A1 | 9/2016 | Hansen | |
| 2016/0319799 | A1 | 11/2016 | Skinner, Jr. et al. | |

FOREIGN PATENT DOCUMENTS

| | | | |
|---|---|---|---|
| EP | 2 389 513 | B1 | 11/2016 |
| FR | 1 053 148 | A | 2/1954 |
| WO | 83/04284 | A1 | 12/1983 |
| WO | 2014/011899 | A2 | 1/2014 |
| WO | 2015/103271 | A2 | 7/2015 |

* cited by examiner

INSERT TYPE ROTOR FOR RADIAL PISTON DEVICE

CROSS-REFERENCE TO RELATED APPLICATION

This application is a U.S. National Stage Application of PCT/US2016/033292, filed on May 19, 2016, which claims the benefit of U.S. Patent Application Ser. No. 62/164,880, filed on May 21, 2015, the disclosures of which are incorporated herein by reference in their entireties. To the extent appropriate, a claim of priority is made to each of the above disclosed applications.

BACKGROUND

In aerospace hydraulic applications, engine driven pumps are used to provide a high volumetric flow rate of pressurized oil flow to hydraulic systems. Examples of the engine driven pumps include radial piston devices that operate as pumps. Radial piston devices (either pumps or motors) are characterized by a rotor rotatably engaged with a pintle. The rotor has a number of radially oriented cylinders disposed around the rotor and supports a number of pistons in the cylinders.

One of driving factors for the engine driven pumps is to increase a power density, which is defined as a power to weight ratio. A higher power density achieves a higher operating efficiency of hydraulic systems and ensures lower operating costs in aerospace systems. Thus, it is important to design a pump with a smaller weight to achieve a higher power density.

SUMMARY

The present disclosure relates generally to a radial piston device with a rotor. In one possible configuration and by non-limiting example, the rotor of the radial piston device includes a rotor body and a rotor insert.

One aspect is a device including a housing, a pintle, a rotor, a plurality of pistons, and a drive shaft. The housing has a hydraulic fluid inlet and a hydraulic fluid outlet. The pintle is attached to the housing and has a pintle shaft. The rotor is rotatably mounted on the pintle shaft and has a plurality of cylinders. The plurality of pistons is displaceable in each of the plurality of cylinders. The drive shaft is coupled to the rotor and rotatably supported within the housing. The pintle shaft defines a first fluid communication between the hydraulic fluid inlet and at least part of the plurality of cylinders and a second fluid communication between at least part of the plurality of cylinders and the hydraulic fluid outlet. The rotor includes a rotor body and a rotor insert received into the rotor body.

In some examples, the rotor body may define an axial bore extending along a rotor axis of rotation. The axial bore is configured to receive the rotor insert. The rotor insert may define a pintle bore rotatably mounted on the pintle shaft. The rotor insert may be received into the axial bore of the rotor body by either interference fit or shrink fit. Alternatively, the rotor insert may be mounted onto the axial bore of the rotor body with an adhesive or bolt joints. The rotor body may be configured to have at least partially the plurality of cylinders, and the rotor insert may be configured to have a plurality of rotor fluid ports. The rotor fluid ports are configured to selectively permit the first fluid communication or the second fluid communication. The plurality of cylinders has a plurality of cylinder sets, and each of the rotor fluid ports may be in fluid communication with each cylinder set. In some examples, the plurality of cylinders comprises a first cylinder set, and the plurality of rotor fluid ports comprises a first rotor fluid port that is in fluid communication with the first cylinder set.

In some examples, the rotor may define a plurality of cylinder sets. Each of the cylinder sets defines a first radial cylinder and a second radial cylinder axially spaced from the first radial cylinder. Each of the first and second radial cylinders receives a piston of the plurality of pistons. Each of the rotor fluid ports may be configured to correspond to each of the cylinder sets and in fluid communication with the first and second cylinders of the corresponding cylinder set. The pintle may define a pintle inlet in fluid communication with the hydraulic fluid inlet and a pintle outlet in fluid communication with the hydraulic fluid outlet. The rotor fluid ports may alternatingly provide fluid communication either between their corresponding first and second cylinders and the pintle inlet, or between their corresponding first and second cylinders and the pintle outlet, as the rotor rotates about the rotor axis.

In other examples, the rotor body may include a radial hollow configured to receive the rotor insert. The rotor body may define a pintle bore rotatably mounted on the pintle shaft. The rotor insert may be received into the radial hollow of the rotor body by either interference fit or shrink fit. Alternatively, the rotor insert may be mounted onto the radial hollow of the rotor body with an adhesive or bolt joints. The rotor insert may comprise at least partially the plurality of cylinders, and the rotor body may comprise a plurality of rotor fluid ports. Each of the rotor fluid ports is configured to selectively permit the first fluid communication or the second fluid communication. The plurality of cylinders has a plurality of cylinder sets, and each of the rotor fluid ports may be in fluid communication with each cylinder set. In some examples, the plurality of cylinders comprises a first cylinder set, and wherein the plurality of rotor fluid ports comprises a first rotor fluid port that is in fluid communication with the first cylinder set.

Another aspect is a radial piston device including a housing, a pintle, a rotor, a plurality of pistons, a thrust ring, and a drive shaft. The housing may have a hydraulic fluid inlet and a hydraulic fluid outlet. The pintle may be attached to the housing and include a pintle shaft defining a pintle inlet and a pintle outlet. The pintle inlet is in fluid communication with the hydraulic fluid inlet, and the pintle outlet is in fluid communication with the hydraulic fluid outlet. The rotor may be mounted on the pintle shaft, and configured to rotate relative to the pintle about a rotor axis of rotation that extends through a length of the pintle shaft. The rotor may include a rotor body and a rotor insert. The rotor body may define an axial bore extending along the rotor axis of rotation and at least partially define a plurality of radially oriented cylinders. The rotor insert may define a pintle bore rotatably mounted on the pintle shaft and define a plurality of rotor fluid ports. The rotor insert is fitted into the axial bore. The plurality of pistons are displaceable in the plurality of radially oriented cylinders. The plurality of rotor fluid ports are in fluid communication with the plurality of radially oriented cylinders, and the plurality of rotor fluid ports are alternately in fluid communication with either the pintle inlet or the pintle outlet as the rotor rotates relative to the pintle about the rotor axis of rotation. The thrust ring is disposed about the rotor, and in contact with each of the plurality of pistons. The thrust ring has a thrust ring axis that is radially offset from the rotor axis of rotation so that the plurality of pistons reciprocates radially within the rotor as the rotor rotates about the rotor axis of rotation. The drive shaft is coupled to the rotor and rotatably supported within the housing. The rotor insert may be received into the axial bore of the rotor body by either interference fit or shrink fit. Alternatively, the rotor insert may be mounted onto the axial bore of the rotor body with an adhesive or bolt joints.

The radial piston device may further comprise a flexible coupling for coupling the drive shaft with the rotor. The flexible coupling may define a flexible coupling flow passage in fluidic communication with the hydraulic fluid inlet and the pintle inlet.

In some examples, the radial piston device is used as a pump in which torque is input to the drive shaft to rotate the rotor. The plurality of radially oriented cylinders may comprise a first cylinder set, and the plurality of rotor fluid ports may comprise a first rotor fluid port that is in fluidic communication with the first cylinder set. When the rotor is in a first position, the first rotor fluid port is in fluid communication with the pintle inlet, and when the rotor is in a second position substantially opposite to the first position around the pintle shaft, the first rotor fluid port is in fluid communication with the pintle outlet. When the rotor is in the first position, fluid is drawn from the hydraulic fluid inlet into the first rotor fluid port via the pintle inlet and is drawn radially outward into the first cylinder set, and when the rotor is in the second position, the fluid is forced from the first cylinder set and the first rotor fluid port into the hydraulic fluid outlet via the pintle outlet.

Yet another aspect is a method of manufacturing a rotor used in a radial piston device. The method may include: forming an axial bore in a rotor body, the axial bore extending along a rotor axis of rotation; forming a plurality of rotor fluid ports in a rotor insert, wherein the rotor insert includes a pintle bore configured to be rotatably mounted on a pintle shaft; inserting the rotor insert into the axial bore of the rotor body; and drilling a plurality of radially oriented cylinders from an outer surface of the rotor body. The step of drilling the plurality of radially oriented cylinders may include drilling a first cylinder set of the plurality of cylinders until the first cylinder set is in fluid communication with a first rotor fluid port of the plurality of rotor fluid port. The step of drilling the plurality of radially oriented cylinders may include drilling at least partially the rotor insert to form at least a portion of each of the plurality of cylinders.

Yet another aspect is a method of manufacturing a rotor used in a radial piston device. The method may include: forming a radial hollow in a rotor body, the rotor body including a pintle bore configured to be rotatably mounted on a pintle shaft; forming a plurality of rotor fluid ports in the rotor body; forming at least partially a plurality of cylinders in a rotor insert; and inserting the rotor insert into the radial hollow of the rotor body. The method may further include forming a ridge portion circumferentially at a corner on a bottom surface of the radial hollow. The ridge portion is configured to define a common fluid chamber between an inner insert surface of the rotor insert and the bottom surface of the radial hollow.

DETAILED DESCRIPTION

Figure 1:
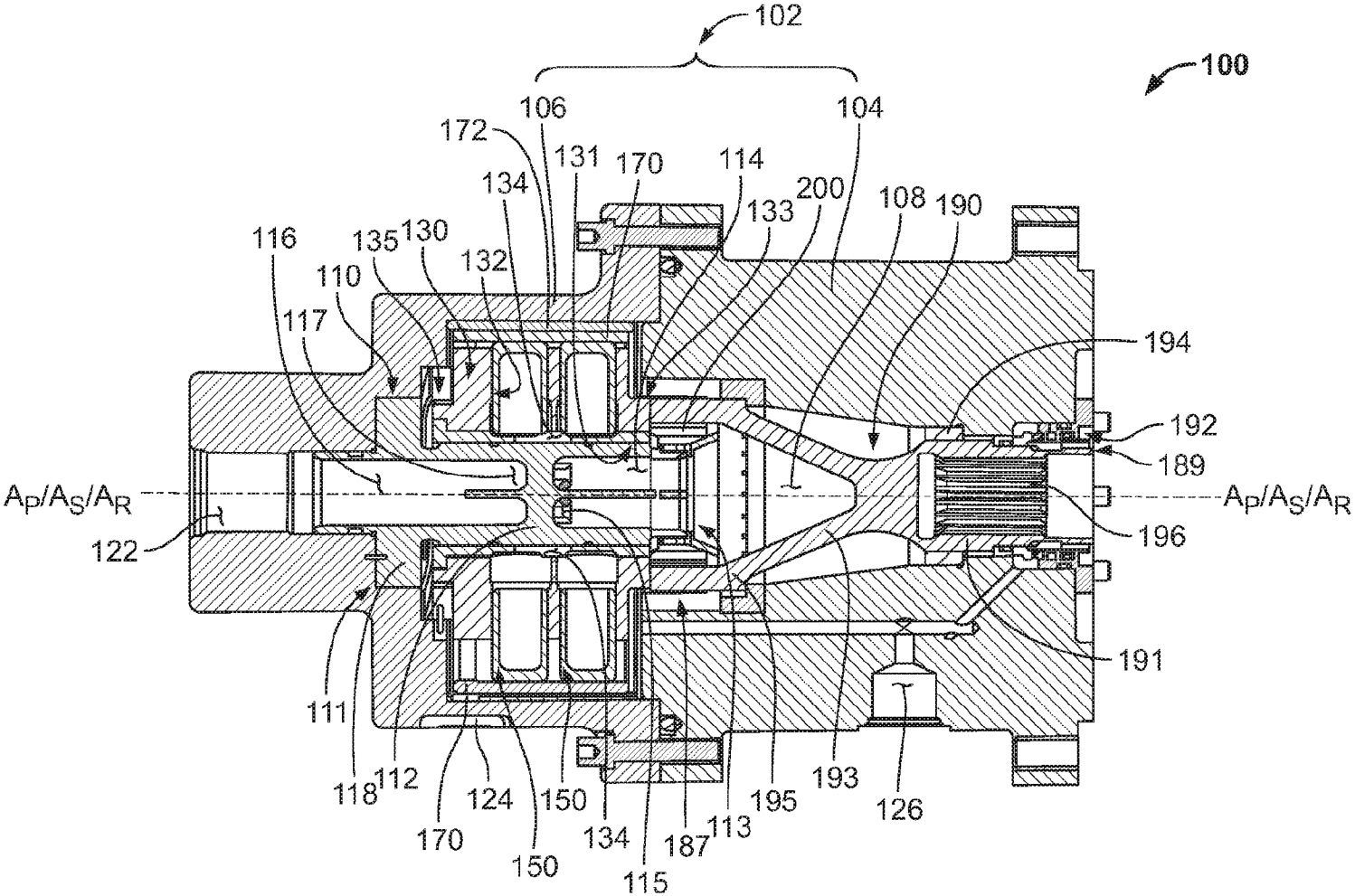
FIG. 1 is a side sectional view of a radial piston device according to one example of the present disclosure.

Various examples will be described in detail with reference to the drawings, wherein like reference numerals represent like parts and assemblies throughout the several views. Reference to various examples does not limit the scope of the disclosure and the aspects upon which the examples are based. Additionally, any examples set forth in this specification are not intended to be limiting and merely set forth some of the many possible ways in which the various aspects of the present disclosure may be put into practice.

In the present disclosure, radial piston devices are described generally. These devices may be used in both motor and pump applications, as required. Certain differences between motor and pump applications are described herein when appropriate, but additional differences and similarities would also be apparent to a person of skill in the art. The radial piston device disclosed herein exhibits high power density, is capable of high speed operation, and has high efficiency. Although the technology herein is described in the context of radial piston devices, the benefits of the technologies described may also be applicable to any device in which the pistons are oriented between an axial position and a radial position.

FIG. 1 is a side sectional view of a radial piston device 100 according to one example of the present disclosure. The radial piston device 100 includes a housing 102, a pintle 110, a rotor 130, a plurality of pistons 150, a thrust ring 170, and a drive shaft 190. The radial piston device 100 may be used as a pump or a motor. When the device 100 operates as a pump, torque is input to the drive shaft 190 to rotate the rotor 130. When the device 100 operates as a motor, torque from the rotor 130 is output through the drive shaft 190. In this disclosure, the device 100 is primarily described as a pump. It is apparent, however, that the same principles and concepts are applicable to the device 100 being used as a motor.

The housing 102 may be configured as a two-part housing that includes a drive shaft housing 104 and a rotor housing 106. The drive shaft housing 104 includes a hydraulic fluid inlet 108 through which hydraulic fluid is drawn into the drive shaft housing 104 when the device 100 operates as a pump. The rotor housing 106 includes a hydraulic fluid outlet 122 through which hydraulic fluid is discharged when the device 100 operates as a pump.

Figure 5:
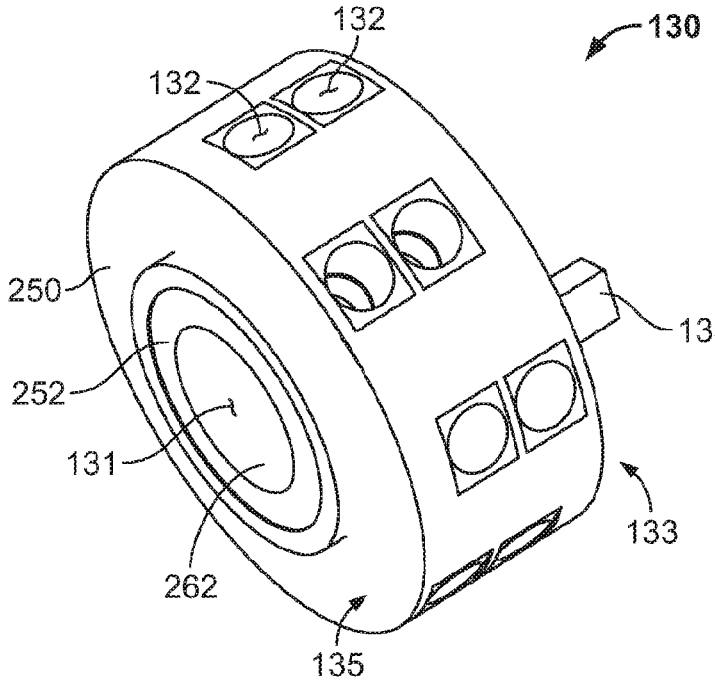
FIG. 5 is a rear perspective view of the rotor of FIG. 4.

The pintle 110 has a first end 111 (also referred to herein as an outlet end) and a second end 113 (also referred to herein as an inlet end) that is opposite to the first end along a pintle axis $A_P$ (FIG. 5). The pintle 110 includes a pintle shaft 112 that protrudes from the first end 111 of the pintle 110 along the pintle axis $A_P$ so that the pintle axis $A_P$ extends through a length of the pintle shaft 112. The pintle shaft 112 has a cantilevered configuration and includes a base end positioned adjacent the first end 111 of the pintle 110 and a free end positioned adjacent the second end 113. The pintle 110 is accommodated within the rotor housing 106 and fixed to the rotor housing 106 at the first end 111 of the pintle 110. The pintle 110 includes a mounting flange 118 at the first end 111 of the pintle 110, and the mounting flange 118 is attached to the rotor housing 106 via fasteners (not shown). The pintle shaft 112 defines a pintle inlet 114 and a pintle outlet 116 therethrough. The pintle inlet 114 and the pintle outlet 116 are substantially aligned with the pintle axis $A_P$. The pintle inlet 114 is in fluidic communication with the hydraulic fluid inlet 108, and the pintle outlet 116 is in fluidic communication with the hydraulic fluid outlet 122.

The pintle 110 may further include an inlet port 115 and an outlet port 117. The inlet port 115 and the outlet port 117 are formed on the pintle shaft 112. In some examples, the inlet port 115 is arranged substantially opposite to the outlet port 117 on the pintle shaft 112. The inlet port 115 is configured to be in fluid communication with the pintle inlet 114, and the outlet port 117 is configured to be in fluid communication with the pintle outlet 116.

The rotor 130 defines a pintle bore 131 that allows the rotor 130 to be mounted on the pintle shaft 112. The rotor 130 has an inlet end 133 and an outlet end 135 that is opposite to the inlet end 133 along a rotor axis $A_R$. The rotor axis $A_R$ extends through the length of the pintle shaft 112 and is coaxial with the pintle axis $A_P$. The rotor 130 is mounted on the pintle shaft 112 so that the outlet end 135 of the rotor 130 is arranged adjacent the first end 111 of the pintle 110 (which is adjacent the mounting flange 118). The inlet end 133 of the rotor 130 is coupled to the drive shaft 190 as explained below.

The rotor 130 is configured to rotate relative to the pintle 110 on the pintle shaft 112 about the rotor axis $A_R$. The rotor 130 defines a number of radial cylinders 132, each of which receives a piston 150. In the depicted example, the cylinders 132 are in paired configurations such that two cylinders 132 are located adjacent each other along a linear axis parallel to the rotor axis $A_R$. In the present application, such linearly-aligned cylinders 132 and pistons 150 are referred to as cylinder sets and piston sets, respectively. Each set includes two axially spaced part cylinders. The cylinders of each set are aligned along a line parallel to the rotor axis of rotation $A_R$.

The rotor 130 includes a plurality of rotor fluid ports 134. Each rotor fluid port 134 is arranged adjacent each of the cylinder sets 220A-220H and configured to open both cylinders 132 of each cylinder set to either the pintle inlet 114 through the inlet port 115 or the pintle outlet 116 through the outlet port 117. Each of the rotor fluid ports 134 is alternatively in fluid communication with either the pintle inlet 114 through the inlet port 115 of the pintle 110 or the pintle outlet 116 through the outlet port 117 of the pintle 110, depending on a rotational position of the rotor 130 relative to the pintle 110 about the rotor axis $A_R$. Accordingly, the rotor fluid port 134 permits for fluidic communication between each cylinder set and either the pintle inlet 114 or the pintle outlet 116. An example of the rotor 130 is described below in further detail with reference to FIGS. 4-10.

The pistons 150 are received in the radial cylinders 132 defined in the rotor 130 and displaceable in the radial cylinders 132, respectively. Each piston 150 is in contact with the thrust ring 170 at a head portion of the piston 150.

The thrust ring 170 is supported radially by the rotor housing 106 and rotatably mounted in the rotor housing 106. The thrust ring 170 may be supported with a hydrodynamic journal bearing 172.

The drive shaft 190 is at least partially located within the drive shaft housing 104. An oil seal assembly 192 surrounds the drive shaft 190 and prevents hydraulic fluid from inadvertently exiting the housing 102. The drive shaft 190 is supported with a plurality of alignment bushings 194 such that there is no radial load on the drive shaft 190.

The drive shaft 190 has a driving end 187 and a power transfer end 189, which is opposite to the driving end 187 along a drive shaft axis of rotation $A_S$. In some examples, the drive shaft 190 includes a shaft head 191, a stem 193 and a power transfer flange 195. The shaft head 191 is configured to be engaged with a driving mechanism (not shown) at the driving end 187 of the drive shaft 190 so that torque is input to the drive shaft 190 to rotate the rotor 130 when the radial piston device 100 operates as a pump. A power transfer flange 195 is configured to be engaged with the rotor 130. The stem 193 extends between the shaft head 191 and the power transfer flange 195. In some examples, the drive shaft 190 is located within the drive shaft housing 104 such that hydraulic fluid entering the drive shaft housing 104 via the hydraulic fluid inlet 108 flows around the stem 193 of the drive shaft 190 and into the pintle inlet 114 of the pintle shaft 112.

The drive shaft 190 is configured to be connected to the rotor 130 at the power transfer end 189 of the drive shaft 190. The drive shaft 190 includes a number of drive splines 196 at the shaft head 191 of the drive shaft 190. In some examples, the drive splines 196 are formed within the shaft head 191. In other examples, the splines may be arranged on an outer surface of the shaft head 191. In some examples, the drive shaft 190 is connected to the inlet end of the rotor 130 at a flexible coupling 200. For example, the power transfer flange 195 of the drive shaft 190 may be connected to the inlet end of the rotor 130 with the flexible coupling 200 therebetween. Examples of the flexible coupling 200 are described in U.S. Patent Application No. 61/922,400, titled HYDRAULIC RADIAL PISTON DEVICES and filed on Jan. 23, 2014, the disclosure of which is incorporated herein by reference in its entirety.

The radial piston device 100 may further include an apparatus for monitoring temperature and/or pressure within the housing 102. Such a monitoring apparatus may be arranged at a number of different locations including a sensor port 124. The radial piston device 100 may include a case drain 126 that is connected to any number of interior chambers of the housing 102.

Figure 2:
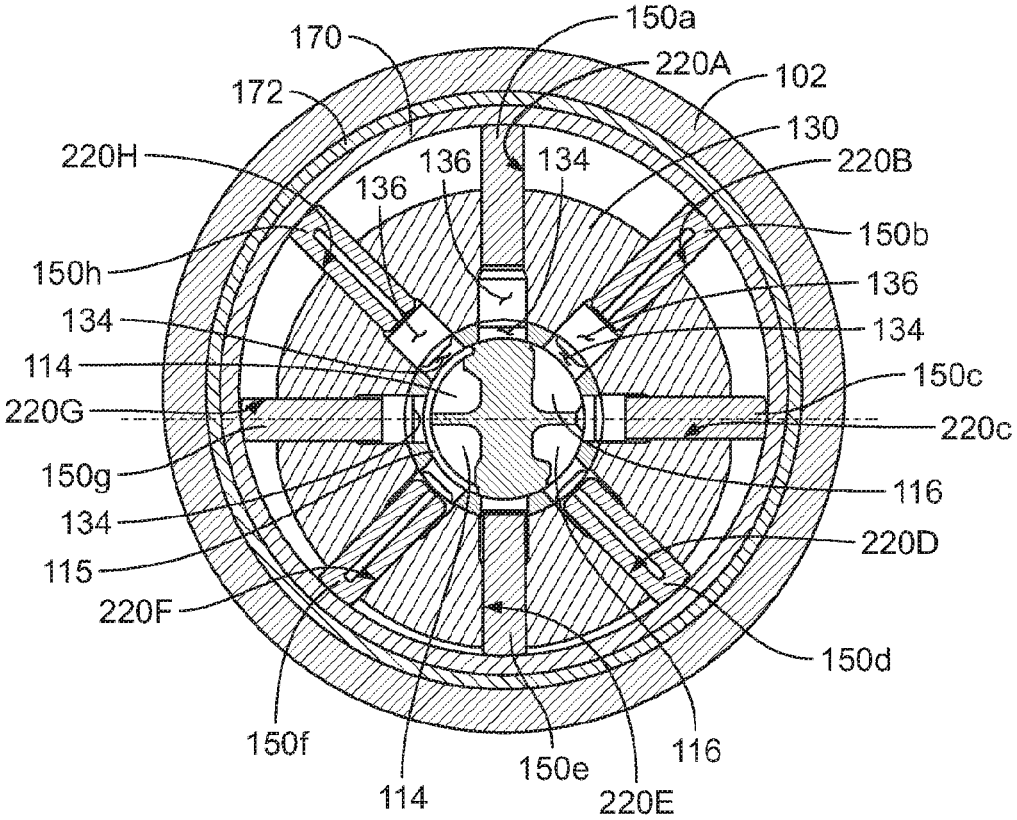
FIG. 2 is an end sectional view of the radial piston device of FIG. 1 with a housing removed.

FIG. 2 is an end sectional view of the radial piston device 100 of FIG. 1 with the housing 102 removed. As shown in FIG. 2, the rotor axis $A_R$ is aligned with the pintle axis $A_P$, but the rotor axis $A_R$ and the pintle axis $A_P$ are not coaxial with a thrust ring axis of rotation. The plurality of pistons 150 reciprocate radially within the rotor 130 as the rotor 130 rotates about the pintle shaft 112 to draw fluid into the cylinders during outward strokes of the pistons and to force fluids from the cylinders during inward strokes of the pistons. Reciprocation of the pistons 150 occurs due to a radial offset (i.e., eccentricity) between the thrust ring 170 and the rotor 130. As a result, the pistons 150 pump once per revolution of the rotor 130 (i.e., the pistons move through one in-stroke and one out-stroke per revolution of the rotor). As shown in FIG. 2, piston 150*a* is located at top dead center (TDC) position (the full out-stroke position) and piston 150*e* is located at bottom dead center (BDC) position (the full in-stroke position). When the rotor 130 is in a position as illustrated in FIG. 2, the rotor fluid ports 134 for the cylinder sets 220F, 220G and 220H are in fluidic communication with the pintle inlet 114. In the same position of the rotor 130, the rotor fluid ports 134 for the cylinder sets 220B, 220C and 220D, which are located opposite to the cylinder sets 220F, 220G and 220H, respectively, are in fluidic communication with the pintle outlet 116. In this position, when the device 100 is operated as a pump and the rotor 130 is rotated by the drive shaft in a direction D, hydraulic fluid is drawn from the hydraulic fluid inlet 108 and flows into the rotor fluid ports 134 for the cylinder sets 220F, 220G and 220H, as the piston sets 150*f*, 150*g* and 150*h* move radially outward in the associated cylinder sets due to the interaction between the rotor 130 and the thrust ring 170. Concurrently, hydraulic fluid is forced from the cylinder sets 220B, 220C and 220D through the corresponding rotor fluid ports 134 and discharged to the hydraulic fluid outlet 122 via the pintle outlet 116 as the pistons sets 150*b*, 150*c* and 150*d* move radially inwardly due to interaction between the rotor 130 and the thrust ring 170.

The interface between the pistons 150 and the inner race of the thrust ring 170 is defined by a spherical piston geometry and raceways formed on the inner race of the thrust ring. This promotes rolling of the pistons 150 on the thrust ring 170 in order to prevent sliding. The thrust ring 170 also rotates as the pistons 150 roll on the thrust ring 170. An even number of cylinder sets are used in order to balance the thrust loads acting on the thrust ring 170. In the depicted example, eight cylinder sets are utilized. Special materials or coatings (such as ceramics or nanocoatings) can be used to decrease the friction and increase the longevity of the piston/ring interface.

Figure 3:
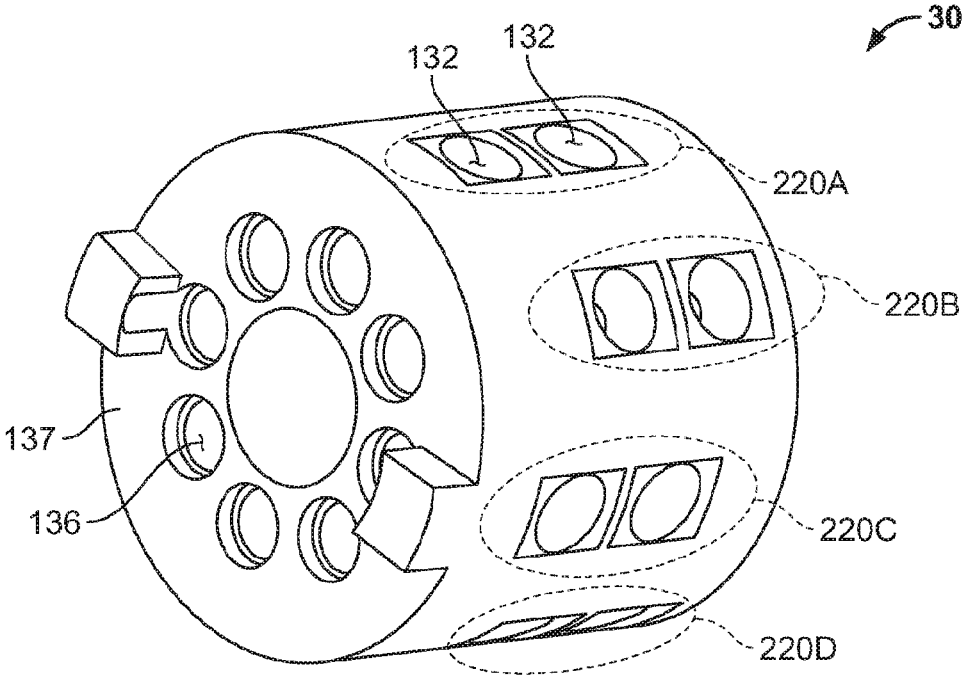
FIG. 3 is a perspective view of an exemplary rotor suitable for the device of FIG. 1.

FIG. 3 is a perspective view of an example rotor 30 that can be used in the device 100 of FIG. 1. As described above, the rotor 30 includes the cylinder sets 220A-220H. 220H. As shown in FIG. 3, the rotor 30 further includes common fluid chambers 136. Each of the common fluid chambers 136 are arranged below each of cylinder sets. The rotor fluid ports 134, as described above, are configured to allow for fluidic communication between each common fluid chamber 136 and each cylinder set. In some examples, the common fluid chambers 136 are in fluidic communication with both cylinders 132 of each cylinder set 220A or 220B. Thus, two cylinders 134 in each cylinder set is bridged by a corresponding fluid chamber 136 so that the two cylinders 134 are in fluid communication with each other. The common fluid chambers 136 are blocked with set screws from an rotor inlet face 137. In alternative examples, common plugs, Welch plugs, brazed plugs, mechanically locked plug pins (i.e., Lee plugs), cast-in plugs, or weldments may be utilized to block the common fluid chambers 136.

In this example, the rotor 30 needs to be drilled in an axial direction parallel with the rotor axis $A_R$ to form the common fluid chambers 136. Thus, the common fluid chambers 136 can introduce a more space than necessary to bridge two cylinders of each cylinder set and, thus, allow an un-swept volume of the hydraulic fluid to form within the common fluid chambers 136. Such an un-swept volume causes a pressure loss of the hydraulic fluid within the device 100, thereby reducing the power density and efficiency of the device 100. Furthermore, the rotor 30 also requires additional elements, such as set screws or plugs to seal the common fluid chambers 136, which increase the overall weight of the device 100.

Figure 4:
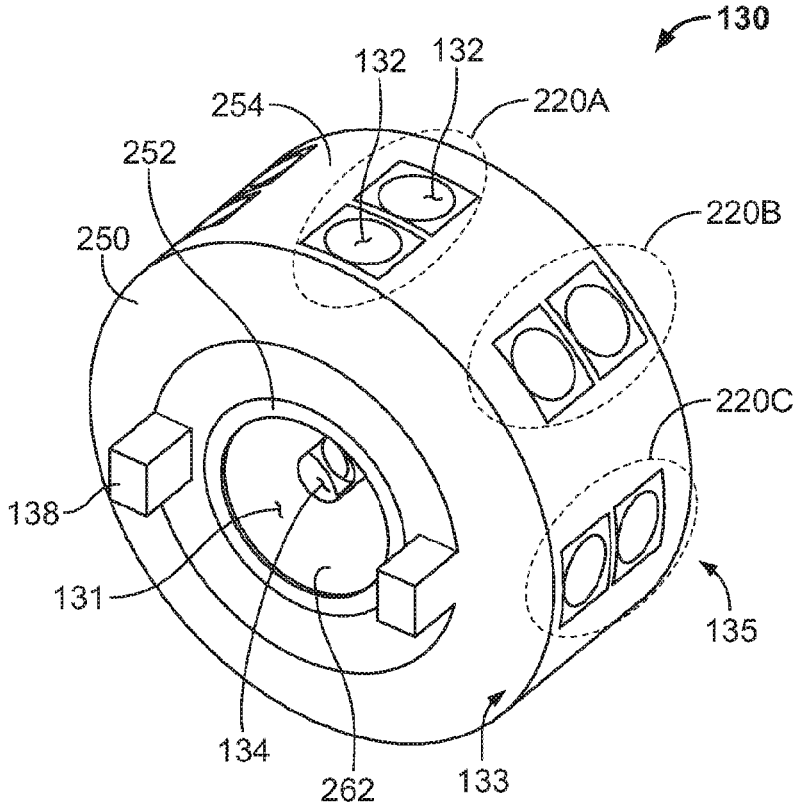
FIG. 4 is a front perspective view of a rotor according to one example of the present disclosure.
Figure 6:
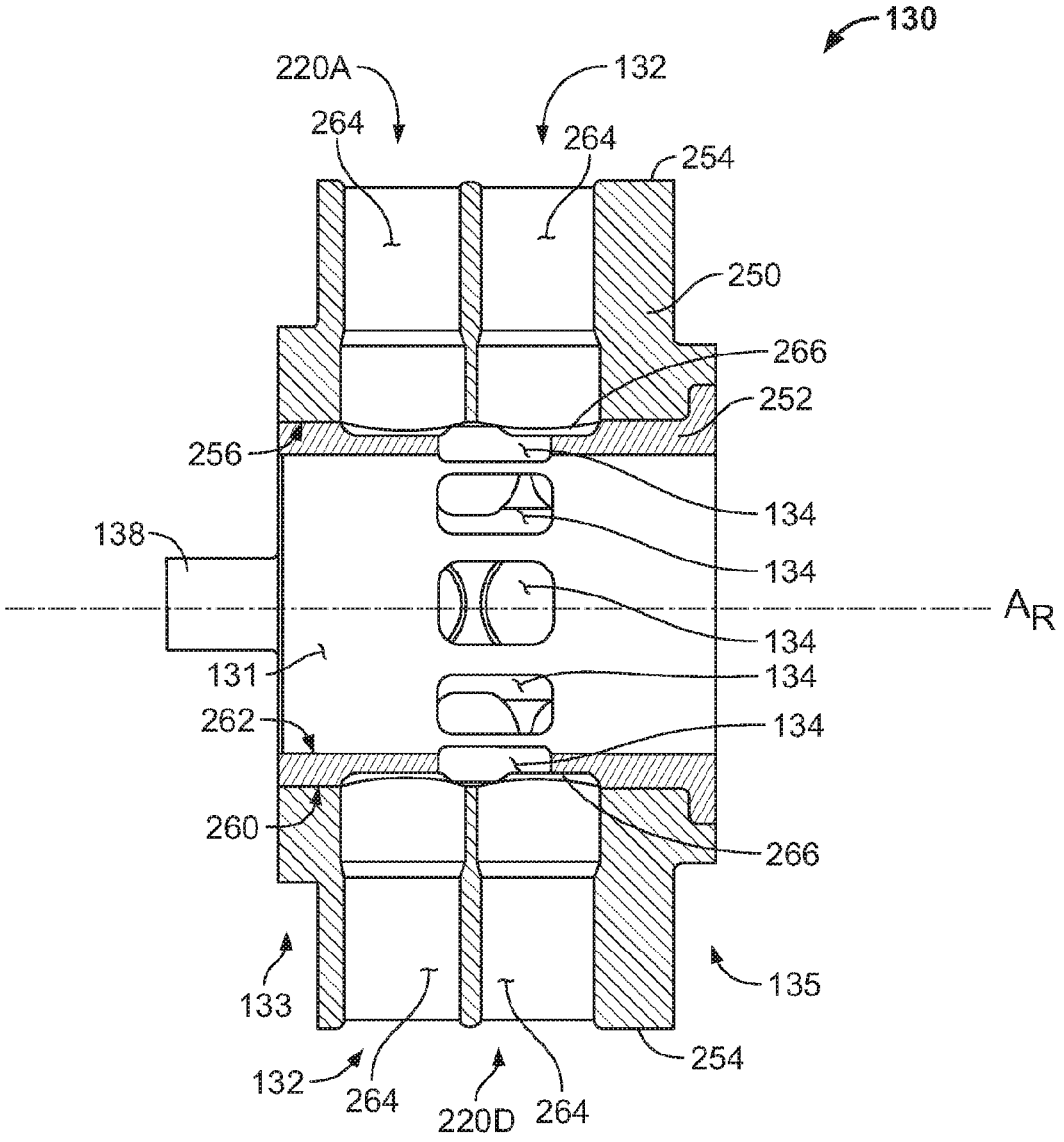
FIG. 6 is a side cross-sectional view of the rotor of FIG. 4.

FIGS. 4-6 illustrate a rotor 130 according to one example of the present disclosure. In particular, FIG. 4 is a front perspective view of an exemplary rotor 130, and FIG. 5 is a rear perspective view of the rotor 130 of FIG. 4. In this example, the rotor 130 includes a rotor body 250 and a rotor insert 252.

The rotor body 250 is configured as a cylindrical shape having an outer body surface 254 and an inner body surface 256 (FIGS. 5 and 6). The inner body surface 256 defines an axial bore 258 (FIG. 8) extending along the rotor axis of rotation $A_R$. The axial bore 258 is configured to receive the rotor insert 252, as described below.

In the depicted example, the rotor body 250 includes the plurality of cylinders 132. As described above, the cylinders 132 are in paired configurations as cylinder sets 220A-220H such that two cylinders 132 of each cylinder set are located adjacent each other along a linear axis parallel to the rotor axis $A_R$. As described below, in some examples, the plurality of cylinders 132 extends onto the rotor insert 252 so that at least a portion of each cylinder 132 is formed on an outer insert surface 260 of the rotor insert 252 (See FIG. 6).

In some examples, the rotor body 250 includes two rotor teeth 138 configured to engage the flexible coupling 200. As described above, the drive shaft 190 includes the power transfer flange 195 at an end of the drive shaft 190 opposite to the shaft head 191 having the drive splines 196. In some examples, the power transfer flange 195 includes a number of shaft teeth (not shown) to engage a first side of the flexible coupling 200. A second side of the flexible coupling 200, which is opposite to the first side of the flexible coupling 200, is engaged with the two rotor teeth 138 of the rotor body 250.

The rotor insert 252 is configured as a cylindrical tube having an outer insert surface 260 (FIG. 6) and an inner insert surface 262. The inner insert surface 262 defines the pintle bore 131 that allows the rotor 130 to be mounted on the pintle shaft 112. The inner insert surface 262 engages the outer surface of the pintle shaft 112 when the rotor 130 is rotatably mounted onto the pintle shaft 112. Thus, the inner insert surface 262 operates as a bearing surface of the rotor 130 with respect to the pintle shaft 112.

The rotor insert 252 includes a plurality of rotor fluid port 134 that extends through the wall of the rotor insert 252 (i.e., between the outer insert surface 260 and the inner insert surface 262). Each rotor fluid port 134 is open to a corresponding cylinder set 220A-220H to bridge both cylinders 132 of each cylinder set 220A-220H. For example, the rotor fluid port 134 is open to both cylinders 132 of the cylinder set 220A so that the cylinders 132 are at least partially open to the pintle bore 131.

In some examples, the rotor insert 252 is made of ductile iron. In other examples, the rotor insert 252 is made of bronze. In yet other examples, the rotor insert 252 may be made of a material of small weight, such as aluminum or plastic. By selecting an appropriate material for the rotor insert 252, the weight of the rotor 130 may be easily manipulated to optimize the performance of the rotor 130 and/or the entire device 100.

The rotor body 250 and the rotor insert 252 can be made with different materials. The rotor insert 252 can be made of a wear-resistant material under rotation. The material of the rotor body 250 can be selected for reducing weight.

FIG. 6 is a side cross-sectional view of the rotor 130 of FIG. 4. As shown, the rotor insert 252 is inserted into the axial bore 258 of the rotor body 250. In some examples, the rotor insert 252 is fitted into the axial bore 258 by interference-fit. In other examples, the rotor insert 252 is fitted into the axial bore 258 by shrink-fit. In yet other examples, the rotor insert 252 can be secured to the axial bore 258 of the rotor body 250 by any manner suitable for fixing the rotor insert 252 to the rotor body 250. For example, the rotor insert 252 can be attached to rotor body 250 with an adhesive. The rotor insert 252 also can be fastened to the rotor body 250 with bolt joints.

In some examples, the plurality of cylinders 132 is defined by a combination of the rotor body 250 and the rotor insert 252. As shown, the rotor body 250 includes a plurality of cylinder bores 264 extending between the outer body surface 254 and the inner body surface 256. Also, the rotor insert 252 includes a plurality of recesses 266 formed on the outer insert surface 260, each of which corresponds to a complementary cylinder bore 264. Thus, when the rotor insert 252 is inserted into the axial bore 258 of the rotor body 250, the plurality of cylinders 132 is formed by the cylinder bores 264 and the corresponding recesses 266. As such, the plurality of cylinders 132 extends through the entire thickness (between the outer body surface 254 and the inner body surface 256) of the rotor body 250 and further extends to a portion of the rotor insert 252 on the outer insert surface 260.

As shown, each of the rotor fluid ports 134 of the rotor insert 252 is configured to be open to both cylinders 132 of each cylinder set 220A so that the two cylinders 132 are partially open to the pintle bore 131. In the depicted example, the rotor fluid ports 134 are configured as substantially a rectangular shape. In other examples, the rotor fluid ports 134 may be modified to have different dimensions and/or shapes depending on several factors for optimizing the performance of the rotor 130 and/or the entire device 100. Examples of such factors include pressure differences at the rotor fluid ports 134, a pressure drop at the device 100, a rotational speed of the rotor 130 about the pintle shaft 112, and the timing or cycle in which the rotor fluid ports 134 are in fluid communication with either the pintle inlet 114 (through the inlet port 115) or the pintle outlet 116 (through the outlet port 117).

Figure 7:
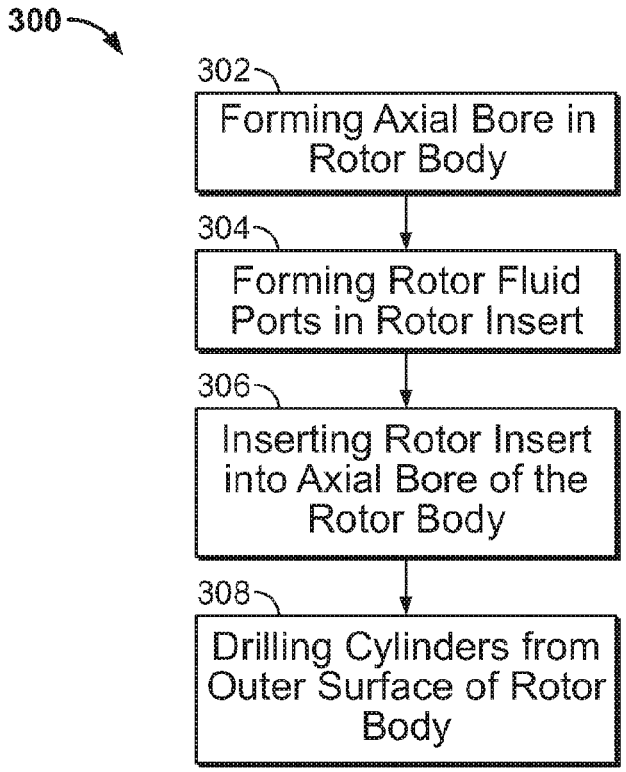
FIG. 7 is a flowchart illustrating an exemplary method of making the rotor of FIG. 4.
Figure 8:
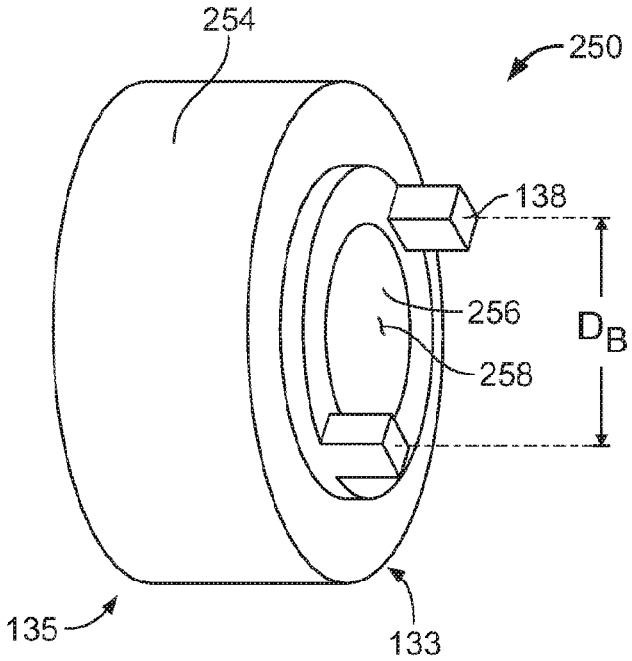
FIG. 8 is a perspective view of an exemplary rotor body used to make the rotor of FIG. 4.
Figure 9:
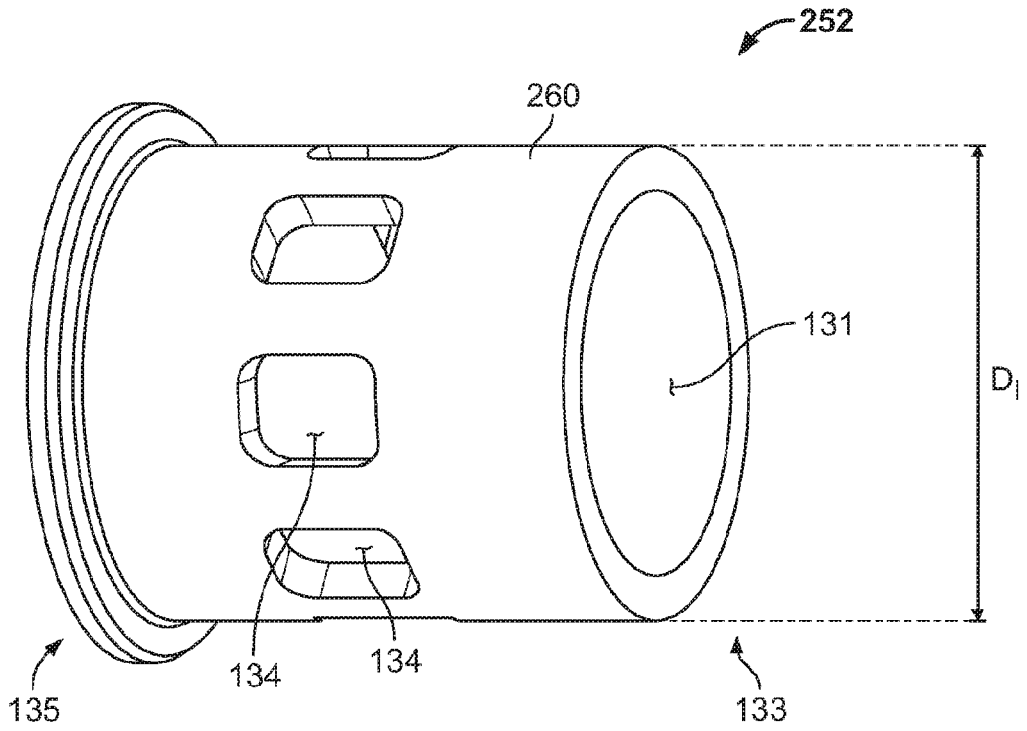
FIG. 9 is a perspective view of an exemplary rotor insert used to make the rotor of FIG. 4.

FIGS. 7-9 illustrate an exemplary method of making the rotor 130 of FIGS. 4-6. FIG. 7 is a flowchart illustrating an exemplary method 300 of making the rotor 130. FIG. 8 is a perspective view of an exemplary rotor body 250 used to make the rotor 130. FIG. 9 is a perspective view of an exemplary rotor insert 252 used to make the rotor 130. Referring to FIG. 7, the method 300 includes operations 302, 304, 306, and 308. The method 300 generally begins at operation 302.

At the operation 302, the axial bore 258 is created in the rotor body 250 along the rotor axis of rotation $A_R$, as shown in FIG. 8. By creating the axial bore 258, the inner body surface 256 is also formed. In some examples, the axial bore 258 has a diameter $D_B$ smaller than an outer diameter $D_I$ of the rotor insert 252 so that the rotor insert 252 is interference-fitted, or shrink-fitted, into the axial bore 258 of the rotor body 250.

At the operation 304, the rotor fluid ports 134 are created in the rotor insert 252, as shown in FIG. 9. The rotor fluid ports 134 are spaced apart circumferentially. It is apparent that the order of performing the operations 302 and 304 do not matter, provided that the operations 302 and 304 are implemented before operation 306.

At the operation 306, the rotor insert 252 is inserted into the axial bore 258 of the rotor body 250. As discussed above, in some examples, the rotor insert 252 is fitted onto the inner body surface 256 by interference-fit or shrink-fit. In other examples, the rotor insert 252 can be secured to the axial bore 258 of the rotor body 250 by any manner suitable for fixing the rotor insert 252 to the rotor body 250. For example, the rotor insert 252 can be attached to rotor body 250 with an adhesive. The rotor insert 252 also can be fastened to the rotor body 250 with bolt joints.

At the operation 308, the cylinders 132 are formed in the assembly of the rotor body 250 and the rotor insert 252. For examples, the cylinders 132 are formed by radially drilling the outer body surface 254 of the rotor body 250. The rotor body 250 is drilled to first create the cylinder bores 264. In some examples, the rotor body 250 is further drilled until the thickness of the rotor insert 252 is partially drilled to form the recesses 266 on the outer insert surface 260, as shown in FIG. 6. The cylinders 132 are created in a manner that both cylinders 132 of each cylinder set 220A are in fluid communication with a corresponding rotor fluid port 134. As such, the cylinders 132 are at least partially open to the pintle bore 131 through the corresponding rotor fluid ports 134.

Figure 10:
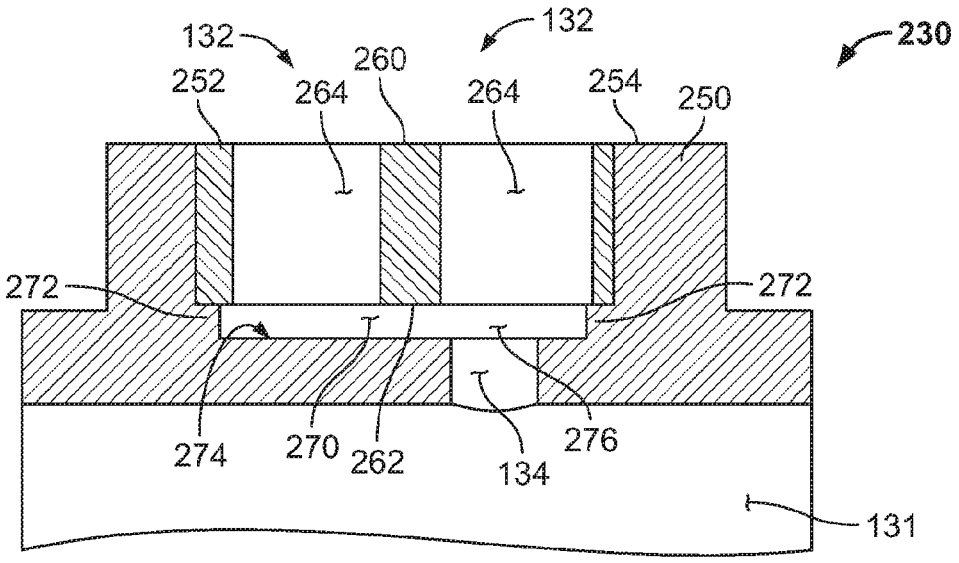
FIG. 10 is a cross-sectional view of a rotor according to another example of the present disclosure.

FIG. 10 is a cross-sectional view of another exemplary rotor 230 according to the principle of the present disclosure. As many of the concepts and features are similar to the first example rotor 130, the description of the rotor 130 is hereby incorporated by reference for this example rotor 230. Where like or similar features or elements are shown, the same reference numbers will be used where possible. The following description for the rotor 230 will be limited primarily to the differences between the rotor 130 and the rotor 230.

In this example, the rotor insert 252 includes cylinder bores 264 extending between the outer insert surface 260 and the inner insert surface 262. The cylinder bores 264 defines the cylinders 132 when the rotor insert 252 is fitted into the rotor body 250. In some examples, the rotor insert 252 is configured to create one cylinder set having two cylinders 132, and, thus, the rotor 230 may have a plurality of the rotor inserts 252 to create a plurality of cylinders 132 around the rotor 230.

The rotor body 250 includes a radial hollow 270 configured to receive the rotor insert 252 from the outer body surface 254 of the rotor body 250. In some examples, the rotor insert 252 is interference-fitted, or shrink-fitted, into the radial hollow 270 of the rotor body 250. In other examples, the rotor insert 252 can be secured to the radial hollow 270 of the rotor body 250 by any manner suitable for fixing the rotor insert 252 to the rotor body 250. For example, the rotor insert 252 can be attached to rotor body 250 with an adhesive. The rotor insert 252 also can be fastened to the rotor body 250 with bolt joints.

The rotor body 250 includes a ridge portion 272 circumferentially formed at the corner on a bottom surface 274 of the radial hollow 270. When the rotor insert 252 is inserted into the radial hollow 270 of the rotor body 250, the rotor insert 252 sits onto the ridge portion 272 to define a common fluid chamber 276 between the inner insert surface 262 of the rotor insert 252 and the bottom surface 274 of the radial hollow 270. The common fluid chamber 276 is configured to bridge the two cylinders 132 and permit fluid communication between the rotor fluid port 134 and the cylinders 132.

As described above, the rotor 130 and 230, which is manufactured in two parts, such as the rotor body 250 and the rotor insert 252, can reduce an un-swept volume of the hydraulic fluid inside the device 100. The rotor 130 and 230 according to the present disclosure can also reduce the weight of the device 100 because it does not require separate elements such as set screws or seal plugs. The rotor body 250 and/or the rotor insert 252 can be conveniently modified with different materials to reduce the weight of the device 100 and improve the rotational performance of the rotor about the pintle shaft. Further, the rotor fluid ports 134 can be conveniently modified with any dimensions or shapes suitable for better control of the timing angles of the rotor and pressure pulsations.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A device comprising:

a housing having a hydraulic fluid inlet and a hydraulic fluid outlet;

a pintle attached to the housing and having a pintle shaft;

a rotor rotatably mounted on the pintle shaft and having a plurality of cylinders;

a plurality of pistons, each being displaceable in each of the plurality of cylinders; and a drive shaft coupled to the rotor and rotatably supported within the housing, wherein the pintle shaft defines a first fluid communication between the hydraulic fluid inlet and at least part of the plurality of cylinders and a second fluid communication between at least part of the plurality of cylinders and the hydraulic fluid outlet, and wherein the rotor includes a rotor body and a rotor insert received into the rotor body, wherein the rotor insert includes a plurality of fluid ports;

wherein the rotor defines a plurality of cylinder sets in fluid communication with the plurality of fluid ports of the rotor insert;

wherein the drive shaft includes a stem portion located within the housing such that hydraulic fluid flows around the stem and into an inlet of the pintle, wherein the stem portion tapers in a direction away from the housing hydraulic fluid outlet.

2. The device according to claim 1, wherein the rotor body defines an axial bore extending along a rotor axis of rotation, the axial bore configured to receive the rotor insert, and wherein the rotor insert defines a pintle bore rotatably mounted on the pintle shaft.

3. The device according to claim 1 wherein the rotor insert is received into the axial bore of the rotor body by either interference fit or shrink fit.

4. The device according to claim 1, wherein the rotor insert is mounted onto the axial bore of the rotor body with an adhesive or bolt joints.

5. The device according to claim 1, wherein the rotor body comprises at least partially the plurality of cylinders, and wherein the rotor insert comprises a plurality of rotor fluid ports, each configured to selectively permit the first fluid communication or the second fluid communication.

6. The device according to claim 1, wherein each of the plurality of cylinder sets defines a first radial cylinder and a second radial cylinder axially spaced from the first radial cylinder, each of the first and second radial cylinders receiving a piston of the plurality of pistons, wherein each of the rotor fluid ports is configured to correspond to each of the cylinder sets and is in fluid communication with the first and second cylinders of the corresponding cylinder set, wherein the pintle defines a pintle inlet in fluid communication with the hydraulic fluid inlet and a pintle outlet in fluid communication with the hydraulic fluid outlet, and wherein the rotor insert fluid ports alternatingly provide fluid communication either between their corresponding first and second cylinders and the pintle inlet, or between their corresponding first and second cylinders and the pintle outlet, as the rotor rotates about the rotor axis.

7. The device according to claim 5, wherein the plurality of cylinders comprises a first cylinder set, and wherein the plurality of rotor fluid ports comprises a first rotor fluid port that is in fluid communication with the first cylinder set.

8. The device according to claim 1, wherein the rotor body includes a radial hollow configured to receive the rotor insert, and wherein the rotor body defines a pintle bore rotatably mounted on the pintle shaft.

9. The device according to claim 8, wherein the rotor insert is received into the radial hollow of the rotor body by either interference fit or shrink fit.

10. The device according to claim 8 wherein the rotor insert is mounted onto the radial hollow of the rotor body with an adhesive or bolt joints.

11. The device according to claim 8, wherein the rotor insert comprises at least partially the plurality of cylinders, and wherein the rotor body comprises a plurality of rotor fluid ports, each configured to selectively permit the first fluid communication or the second fluid communication.

12. The device according to claim 11, wherein the plurality of cylinders comprises a first cylinder set, and wherein the plurality of rotor fluid ports comprises a first rotor fluid port that is in fluid communication with the first cylinder set.

13. A radial piston device comprising:

a housing having a hydraulic fluid inlet and a hydraulic fluid outlet;

a pintle attached to the housing, the pintle including a pintle shaft defining a pintle inlet and a pintle outlet, the pintle inlet being in fluid communication with the hydraulic fluid inlet, the pintle outlet being in fluid communication with the hydraulic fluid outlet;

a rotor mounted on the pintle shaft, the rotor being configured to rotate relative to the pintle about a rotor axis of rotation that extends through a length of the pintle shaft, the rotor comprising:

a rotor body defining an axial bore extending along the rotor axis of rotation and at least partially defining a plurality of radially oriented cylinders; and a rotor insert defining a pintle bore rotatably mounted on the pintle shaft and defining a plurality of rotor fluid ports, wherein the rotor insert is fitted into the axial bore and;

a plurality of pistons, each being displaceable in each of the plurality of radially oriented cylinders, wherein the plurality of rotor fluid ports are in fluid communication with the plurality of radially oriented cylinders, and wherein the plurality of rotor fluid ports are alternately in fluid communication with either the pintle inlet or the pintle outlet as the rotor rotates relative to the pintle about the rotor axis of rotation;

a thrust ring disposed about the rotor, wherein the thrust ring is in contact with each of the plurality of pistons, and wherein the thrust ring has a thrust ring axis that is radially offset from the rotor axis of rotation so that the plurality of pistons reciprocate radially within the rotor as the rotor rotates about the rotor axis of rotation; and a drive shaft being coupled to the rotor and rotatably supported within the housing, wherein the drive shaft includes a stem portion located within the housing such that hydraulic fluid flows around the stem and into the pintle inlet, wherein the stem portion tapers in a direction away from the housing hydraulic fluid outlet.

14. The device according to claim 13, wherein the rotor insert is received into the axial bore of the rotor body by either interference fit or shrink fit.

15. The device according to claim 13, wherein the rotor insert is mounted onto the axial bore of the rotor body with an adhesive or bolt joints.

16. The radial piston device according to claim 13, further comprising a flexible coupling for coupling the drive shaft with the rotor.

17. The radial piston device according to claim 16, wherein the flexible coupling defines a flexible coupling flow passage in fluidic communication with the hydraulic fluid inlet and the pintle inlet.

18. The radial piston device according to claim 13, wherein the radial piston device is used as a pump in which torque is input to the drive shaft to rotate the rotor.

19. The radial piston device of claim 18, wherein the plurality of radially oriented cylinders comprises a first cylinder set, and wherein the plurality of rotor fluid ports comprises a first rotor fluid port that is in fluidic communication with the first cylinder set, wherein when the rotor is in a first position, the first rotor fluid port is in fluid communication with the pintle inlet, and wherein when the rotor is in a second position substantially opposite to the first position around the pintle shaft, the first rotor fluid port is in fluid communication with the pintle outlet, wherein when the rotor is in the first position, fluid is drawn from the hydraulic fluid inlet into the first rotor fluid port via the pintle inlet and is drawn radially outward into the first cylinder set, and wherein when the rotor is in the second position, the fluid is forced from the first cylinder set and the first rotor fluid port into the hydraulic fluid outlet via the pintle outlet.

20. A method of manufacturing a rotor used in a radial piston device, the method comprising:

forming a radial hollow in a rotor body, wherein the rotor body includes a pintle bore configured to be rotatably mounted on a pintle shaft;

forming a plurality of rotor fluid ports in the rotor body;

forming at least partially a plurality of cylinders in the rotor body; and forming a ridge portion circumferentially at a corner on a bottom surface of the radial hollow, the ridge portion configured to define a common fluid chamber between an inner insert surface of the rotor insert and the bottom surface of the radial hollow;

inserting the rotor insert into the radial hollow of the rotor body such that the plurality of plurality of cylinders are in fluid communication with the plurality of rotor fluid ports.

21. The device of claim 1, wherein at least some of the plurality of cylinder sets are located axially more proximate to an inlet end of the rotor in comparison to others of the plurality of cylinder sets.

22. The device of claim 1, wherein the housing defines an interior wall tapering in the same direction as the drive shaft stem portion.

* * * * *